United States Patent [19]

Gittler

[11] 4,079,652

[45] Mar. 21, 1978

[54] ELECTRIC GUITAR

[76] Inventor: Allan Gittler, 205 E. 26th St., New York, N.Y. 10010

[21] Appl. No.: 747,379

[22] Filed: Dec. 3, 1976

[51] Int. Cl.[2] ..... G10H 3/00; G10H 1/08

[52] U.S. Cl. ..... 84/1.16; 84/1.15; 84/267; 84/293; 84/DIG. 3 D

[58] Field of Search ..... 84/1.14–1.15, 84/267, 293, DIG. 30

[56] References Cited

U.S. PATENT DOCUMENTS

| | | | |
|---|---|---|---|
| 2,500,172 | 3/1950 | Gillenwater | 84/315 X |
| 3,301,936 | 1/1967 | Carmen | 84/1.16 |

*Primary Examiner*—Edith S. Jackmon
*Attorney, Agent, or Firm*—Peter L. Tailer

[57] ABSTRACT

An electric guitar has a neck and body formed from a solid metal rod. Fret bars are pressed in slots cut across the rod to extend outward from the rod in its neck portion. Combination pickups and tuners are longitudinally positioned adjacent to the body portion of the rod and secured by two positioning bars and a bridge.

10 Claims, 14 Drawing Figures

FIG. 5
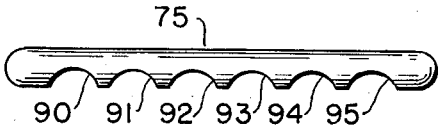
FIG. 6
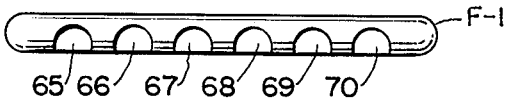
FIG. 7
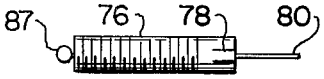
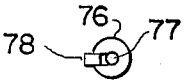
FIG. 8
FIG. 9
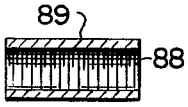
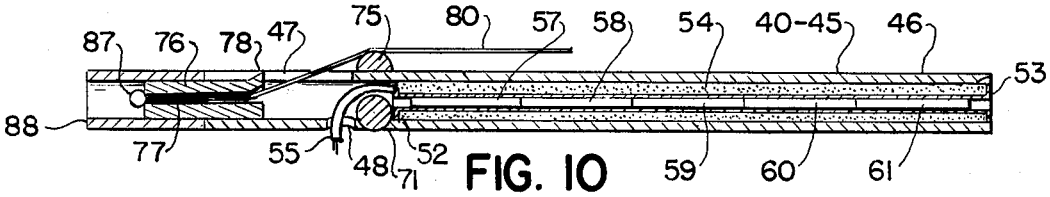
FIG. 10
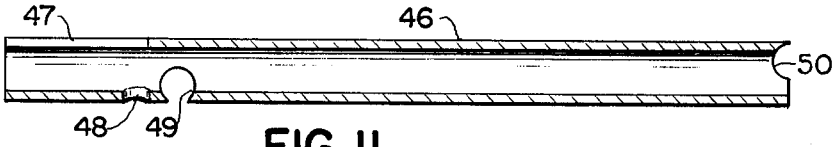
FIG. 11
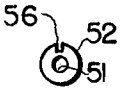
FIG. 13
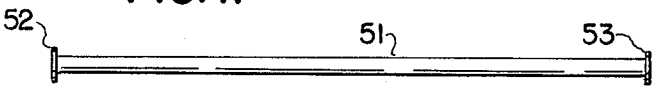
FIG. 12
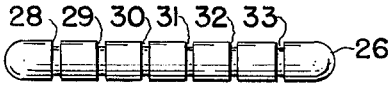
FIG. 14

ELECTRIC GUITAR

BACKGROUND OF THE INVENTION

1. Field of the Invention

This invention relates to guitars with electronic pickups.

2. Description of the Prior Art

Heretofore electric guitars have had wooden necks with metal frets fixed across the necks, the necks as well as the frets extending under the width span of the strings. The positioning of frets in wooden necks cannot be accomplished with extreme accuracy. The strings of a conventional guitar are tuned at the neck end which prevents tuning while sustaining a cord or fretting. The inaccuracy of fret placement and other construction features limits the range of conventional electric guitars. Conventional guitars have further disadvantages compared to the guitar of this invention.

SUMMARY OF THE INVENTION

An electric guitar has a solid metal rod across which slots are cut to have pressed therein transverse fret bars along a neck portion. Positioning bars and a bridge secure combination pickups and tuners adjacent to the body end of the rod.

This invention completely revolutionizes the electric guitar as a musical instrument as it provides many advantages. As it is machined from solid metal stock except for the tubular pickups, fret bars can be located with an accuracy of 0.002 cm. This precision construction enables the guitar to be built with a much greater range than a conventional instrument. If the pickups are fanned slightly at their outward ends to lie parallel to and under the strings, they can be used as indefinite frets to further extend the range upward.

The round fret bars provide unprecedented gliss or smoothness. If wear is evidenced on the fret bars over the years, they may be rotated in their slots to present unworn surfaces. Since the guitar is tuned at the body end, it can be tuned while playing as a chord is held. The new string mounting allows strings to be easily removed and replaced for cleaning unlike conventional string mountings which bend, flex, and destroy them. Since there is no fret board under the strings to interfere with finger pressure and placement, the guitar of this invention gives greater control feel and nuance over the strings. In addition the lack of a fret board allows any string to be struck between frets. Many other advantages arise from the specific construction of the guitar of this invention.

BRIEF DESCRIPTION OF THE DRAWING

FIG. 5 is a rear view of a bridge;

FIG. 6 is a rear view of a combination front positioning bar for pickups and a first fret bar;

FIG. 7 is a front view of a guitar string tuning stud;

FIG. 8 is an end view of the stud of FIG. 7;

FIG. 9 is a longitudinal section through a knurled tuning nut;

FIG. 10 is a longitudinal section through a combination electronic pickup and tuner;

FIG. 11 is a longitudinal section through a pickup casing tube;

FIG. 12 is a side view of a flared core tube on which a coil is to be wound;

FIG. 13 is an end view of the core tube of FIG. 12; and,

FIG. 14 is a rear view of a string positioning bar.

DESCRIPTION OF THE PREFERRED EMBODIMENT

Figure 1:
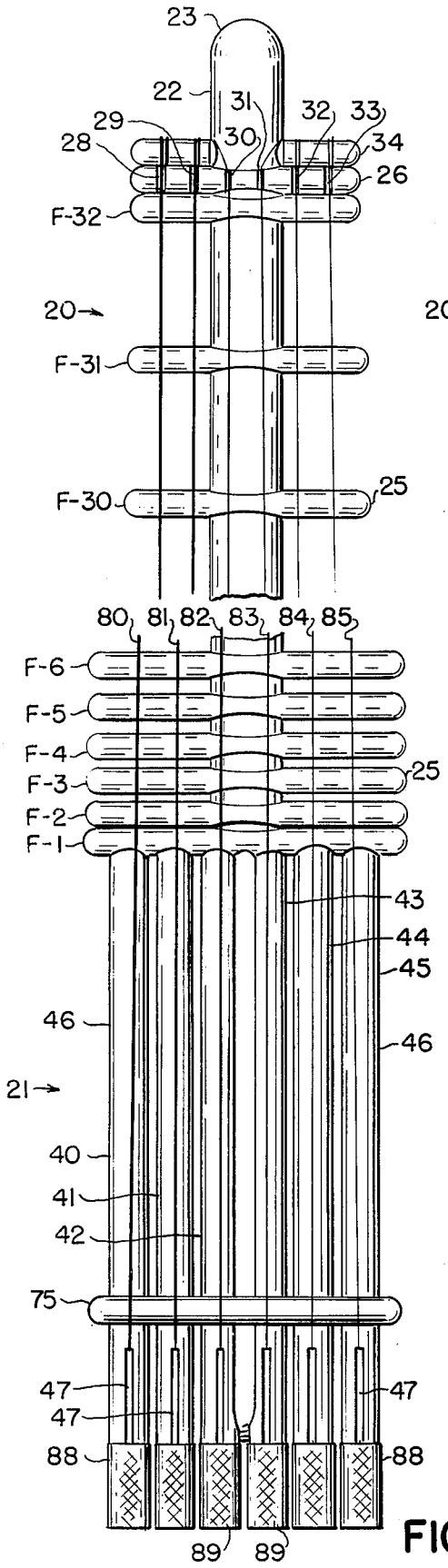
FIG. 1 is a front view of a guitar according to this invention with a large central portion broken away.
Figure 2:
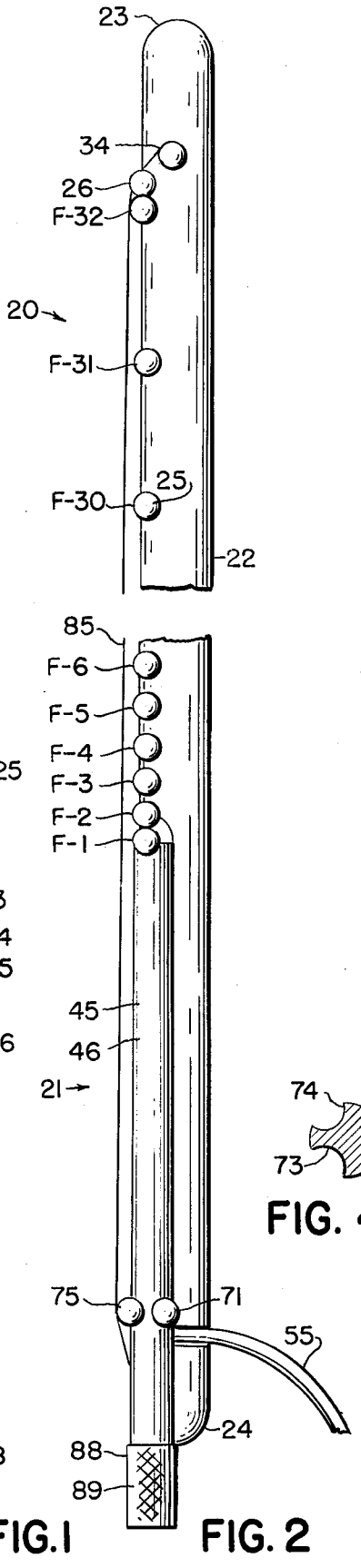
FIG. 2 is a side view of the guitar of FIG. 1.
Figure 4:
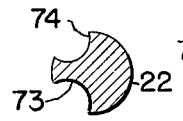
FIG. 4 is a transverse section taken on line 4—4 of FIG. 3.

Referring to FIGS. 1 and 2, the guitar of this invention has a neck portion 20 and a body portion 21 which differ completely from those of any conventional guitar. They are formed by the single solid metal rod 22 which is crossed by the frets F-1 through F-32 to form neck 20 and which mounts the pickups 40–45 longitudinally to form the body 21.

Figure 3:
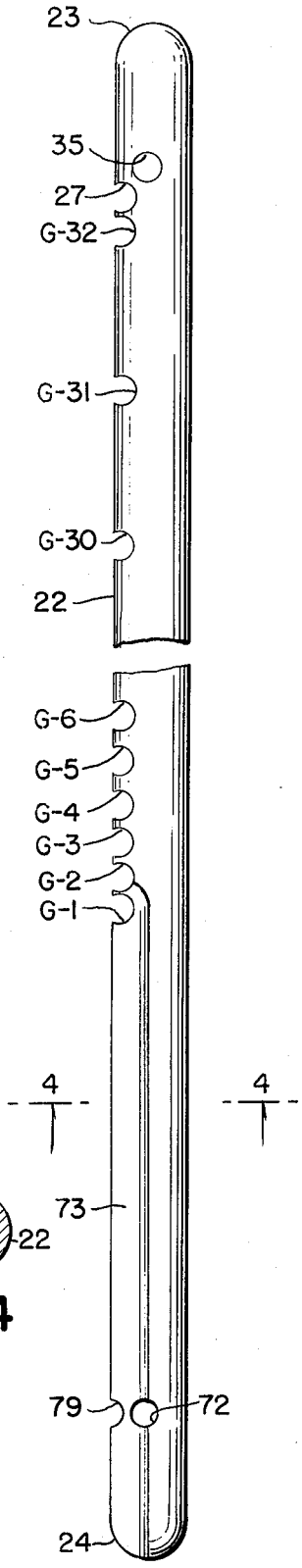
FIG. 3 is a side view of a metal rod forming the neck and body of the guitar with a central portion broken away.

As may be seen in FIG. 3, rod 22 is a solid cylindrical rod with rounded ends 23 and 24. Precision machined cylindrical grooves G-1 through G-32 are formed across the top of rod 22. Fret bars F-1 through F-32 are pressed into grooves G-1 through G-32. The fret bars F-1 through F-32 have rounded ends 25 and are progressively shorter from the longest fret bar F-1 to the 30 second and last fret bar F-32.

Referring additionally to FIG. 14, a string spacing bar 26 is pressed in a groove 27 formed adjacent to groove G-32. Bar 26 has circumferential equally spaced string slots 28–33 machined in it. As may be seen in FIGS. 1, 2, and 3, a string tie bar 34 is pressed in aperture 35 to transfix the neck end of rod 22 beyond string spacing bar 26.

Six pickups 40–45 also serve as tuners and are shown in FIGS. 10–13. Each pickup 40–45 has an outer tubular body 46. A longitudinal slot 47 is formed at the top rear end of each tubular body 46. A vertical opening 48 is formed below the front end of slot 47 at the bottom of each tubular body 46. A transverse cylindrical slot 49 is formed in front of the opening 48. The front or neck facing end of each tubular body 46 has a transverse cylindrical slot 50 cut in its upper half.

Each pickup 40–45 contains a core tube 51 with flares 52 and 53 at its ends. Many thousands of turns of fine wire 54 are wound about each core tube 51 and wrapped with tape (not shown) to hold them in place. The turns or windings 54 of each pickup 40–45 are connected to insulated two wire leads 55 that pass through slot 56 in flare 52 and then through opening 48 as may be seen in FIG. 10. A number of bar magnets 57–61 are cemented in each core tube 51. The magnets 57–61 can be disposed with each south pole next to the north pole of an adjacent magnet. The vibrations from plucked strings induce currents to flow in the windings 54 which are then amplified in the well known manner.

Fret bar F-1 also serves as a front positioning bar for the pickups 40–45. As may be seen in FIG. 6, fret and positioning bar F-1 contains rearwardly facing round openings 65–70 which are substantially the inside diameter of the tubular bodies 46 and disposed substantially the wall thickness of the tubular bodies 46 below the top of fret and positioning bar F-1. The front flare 53 of core tube 51 of each pickup 40–45 extends into an opening 65–70 to position the front ends of the pickups 40–45.

Referring now to FIGS. 1–5 and 10, a rear positioning bar 71 extends through aperture 72 in rod 22 to transfix it. Bar 71 also passes through the transverse slots 49 of the tubular bodies 46 of the pickups 40–45. Rod 22 contains two longitudinal grooves 73 and 74 to accommodate the two centrally located pickups 42 and 43. A bridge 75 is placed over the pickups 40–45. Bridge 75 contains notches 90–95 in its lower surface to fit about and laterally position the rear ends of the pickups 40–45. A notch 79 formed transversely in the top of rod 22 longitudinally positions bridge 75.

As may be seen in FIGS. 7, 8, and 10, a threaded stud 76 extends into the rear end of each pickup 40–45 and has a front upward extension 78 which extends into and slides in a slot 47 to prevent rotation of stud 76. Each stud 76 contains an axial bore 77 through which one of the guitar strings 80–85 is passes until its large end bead 87 is stopped at the back of a stud 76. A cylindrical tuning nut 88 with a knurled outer surface 89 is turned about each stud 76 and bears against the end of a tubular body 46 to tension and tune a string 80–85. Each string 80–85 passes out of a slot 47 over bridge 75. This holds the bridge 75 in place and positions the strings 80–85 over the pickups 46 and the fret bars F-1 through F-32. As shown in FIGS. 1 and 2, the strings 80–85 each pass through a slot 28–33 is spacing bar 26 and are fixed to tie bar 34 by a simple half hitch or a double half hitch if desired. This does not deform the strings 80–85 st that they may be easily removed for cleaning and replaced.

A guitar according to this invention was made from 1.905 cm. diameter stainless steel rod to form rod 22. Fret bars F-1 through F-32 and the other bars 26, 34, and 71 and bridge 75 were made from 0.635 cm. diameter stainless steel rod. The tubular bodies 46 were made from stainless steel tubing 0.919 cm. OD and 0.635 cm. ID. Core tube 51 was also made from stainless steel tubing having a 0.0254 cm. wall and a 0.318 cm. ID. A thin support cord (not shown) to help hold the guitar while playing was fixed about rod 22 and pickups 42 and 43 behind bridge 75 and under strings 82 and 83 at one end and fixed about rod 22 beyond bar 34 at the other end.

While this invention has been shown and described in the best form known, it will nevertheless be understood that this is purely exemplary and that modifications may be made without departing from the spirit of the invention. For example, fret bars F-1 through F-32 of prismatic or other shapes can be pressed in slots in a rod 22 that is other than round in section, or they may be fixed by welding or otherwise. The pickups 40–45 can be otherwise constructed. One limitation that is central to this invention is that the width of the bed 22 should be less than the distance between strings 81 and 84.

What is claimed is:

1. A guitar comprising, in combination, a longitudinal metal rod, metal fret bars fixed across said rod and extending a distance greater than the width of said rod forming a neck portion of said guitar, longitudinally disposed pickups mounted to said rod adjacent to said neck portion forming a body portion of said guitar, guitar strings fixed to said pickups extending over said fret bars, and means securing said strings at the neck end of said guitar.

2. The combination according to claim 1 wherein said guitar has six of said strings, said rod being of a width less than the distance between said second and said fifth string.

3. The combination according to claim 2 wherein said rod has cylindrical grooves formed therein, said rod and said fret bars being of solid cylindrical stock, said fret bars being pressed into said cylindrical grooves.

4. The combination according to claim 3 wherein said pickups are combination pickups and tuners, each of said pickups and tuners having an outer tubular body containing an upwardly disposed rearward longitudinal slot, an electronic pickup means within said tubular body, a threaded stud containing a longitudinal bore and a forward upward extension, and a tuning nut screwed about said stud and bearing against said tubular body, said stud extending into said tubular body with said upward extension sliding in said longitudinal slot, said strings having beads at the ends thereof and each string being threaded through an axial bore until retained by its bead, each string extending out of one of said longitudinal slots, rotation of said tuning nuts tuning said strings.

5. The combination according to claim 4 with the addition of a bridge containing lower notches and being disposed across said pickups in front of said longitudinal slots, said strings extending over said bridge clamping said bridge against said pickups with said pickups extending into notches of said bridge.

6. The combination according to claim 5 with the addition of a rear positioning bar transfixing said rod, notches in said tubular bodies receiving said rear support bar therethrough positioning the rear ends of said pickups thereby, and a front positioning bar fixed in said rod, said front positioning bar containing rearwardly facing openings, said electronic pickup means in said tubular bodies entering said rearwardly facing openings positioning the front ends of said pickups thereby.

7. The combination according to claim 6 wherein said rod has an upward facing notch receiving and positioning said bridge over said rear positioning bar.

8. The combination according to claim 7 wherein said front positioning bar is the first of said fret bars.

9. The combination according to claim 8 whererin said means securing said strings at the neck end of said guitar is a circumferentially grooved string spacing bar fixed to said rod adjacent to the last of said fret bars, and a string tie bar transfixing said rod in front of said string spacing bar, each string passing through a groove in said string spacing bar and being fixed by at least one half hitch to said tie bar.

10. The combination according to claim 9 wherein said fret bars are progressively shorter toward the neck end of said guitar and said pickups fan outward slightly to lie directly under said strings.

* * * * *